US007060042B2

(12) United States Patent
Huang

(10) Patent No.: US 7,060,042 B2
(45) Date of Patent: Jun. 13, 2006

(54) MASSAGE DEVICE

(76) Inventor: Chien-Ming Huang, 11-1 Fl., No. 23, Sec. 2, Keelung Rd., Taipei (TW)

( * ) Notice: Subject to any disclaimer, the term of this patent is extended or adjusted under 35 U.S.C. 154(b) by 112 days.

(21) Appl. No.: 10/954,690

(22) Filed: Sep. 29, 2004

(65) Prior Publication Data

US 2006/0069328 A1 Mar. 30, 2006

(51) Int. Cl.
*A61H 7/00* (2006.01)
*A61H 23/00* (2006.01)

(52) U.S. Cl. ..... 601/86; 601/90; 601/95; 601/98; 601/112

(58) Field of Classification Search ..... 601/84, 601/86, 87, 89, 90, 93–95, 97, 98, 100, 101, 601/103, 104, 107, 108, 110–112, 116, 126, 601/133, 134
See application file for complete search history.

(56) References Cited

U.S. PATENT DOCUMENTS 5,063,911 A * 11/1991 Teranishi ..... 601/46
5,183,034 A * 2/1993 Yamasaki et al. ..... 601/70
5,305,738 A * 4/1994 Shimizu ..... 601/75
5,935,089 A * 8/1999 Shimizu ..... 601/111
6,837,861 B1 * 1/2005 Lin ..... 601/87

* cited by examiner

*Primary Examiner*—Quang D. Thanh
(74) *Attorney, Agent, or Firm*—Dellett & Walters

(57) ABSTRACT

A massage device has a platform, a motor assembly, a worm gear assembly, a rocker arm assembly and two rotation assemblies. The platform has two shoulder brackets. The motor assembly has a motor mounted on the platform and a worm mounted to the motor. The worm gear assembly is mounted on the platform and has two worm gears engaging with the worm shaft. The rocker arm assembly has two rocker arms. The rocker arms are mounted pivotally on a shoulder. Each rotation post assembly has an eccentric wheel, a spring and a top kneading head. The rocker arm and rotation assemblies provide multiple effective massages to different groups of muscles of a human body to mitigate the ache of the muscles.

4 Claims, 10 Drawing Sheets

MASSAGE DEVICE

BACKGROUND OF THE INVENTION

1. Field of the Invention

The present invention relates to a massage device, and more particularly to a massage device for massaging multiple muscle groups of the human body, such as the foot and back.

2. Description of Related Art

Massage devices are used to soothe tense muscles of a user so as to let the user feel at ease physically. Various known massage apparatuses have been proposed which employ vibrating or rotating members. However, such known apparatuses only provide single massaging action to one muscle group of the human body, such as foot muscles.

To overcome the shortcomings, the present invention provides a massage device to mitigate or obviate the aforementioned problems.

SUMMARY OF THE INVENTION

The main objective of the invention is to provide a massage device that applies multiple effective massaging actions to multiple parts of the human body, and which simulates the action of a human masseur at least to some extent.

A massage device in accordance with the present invention has a platform, a motor assembly, a worm gear assembly, a rocker arm assembly and two rotation assemblies.

The platform has two shoulder brackets. The motor assembly has a motor mounted on the platform and a worm mounted to the motor. The worm gear assembly is mounted on the platform and has two worm gears engaging with the worm shaft. The rocker arm assembly has two rocker arms. The rocker arms are mounted pivotally on the shoulder. Each rotation post assembly has an eccentric wheel, a spring and a top kneading head.

Other objectives, advantages and novel features of the invention will become more apparent from the following detailed description when taken in conjunction with the accompanying drawings.

DETAILED DESCRIPTION OF PREFERRED EMBODIMENT

Figure 1:
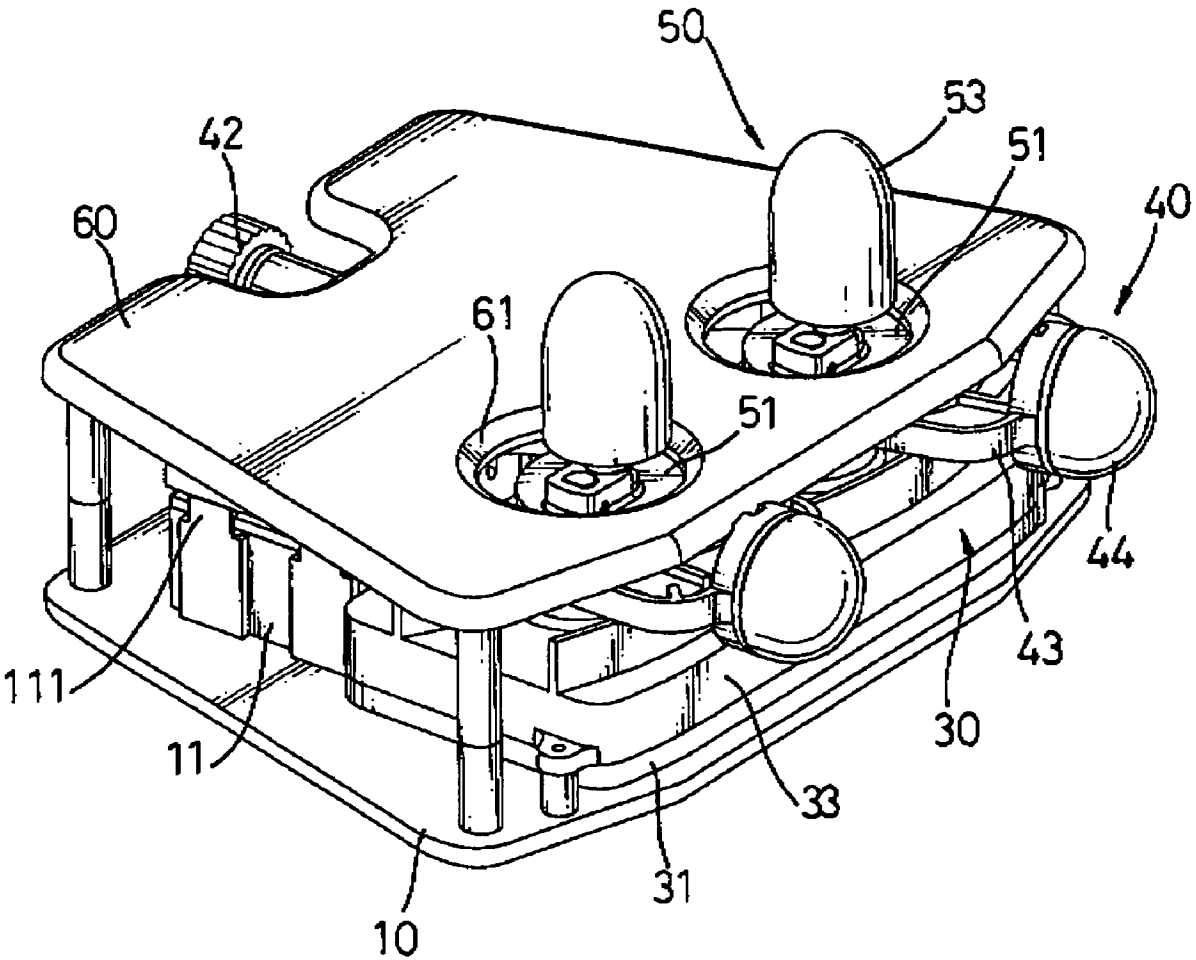
FIG. 1 is a perspective view of a massage device in accordance with the present invention.
Figure 2:
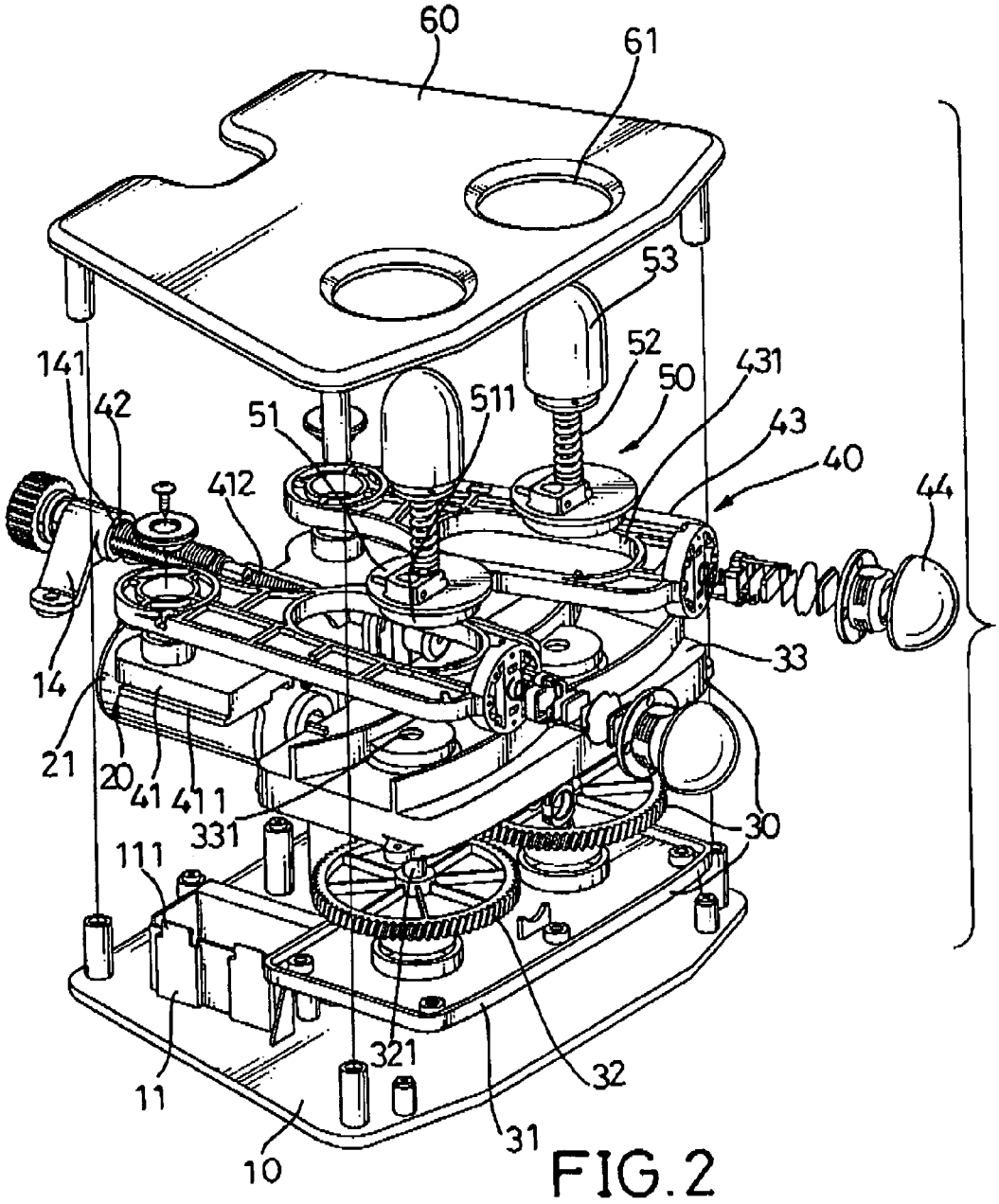
FIG. 2 is an exploded view of the massage device in FIG. 1.

With reference to FIGS. 1 and 2, a massage device in accordance with the present invention comprises a platform (10), a motor assembly (20), a worm gear assembly (30), a rocker arm assembly (40), two rotation assemblies (50) and a top cover (60).

The platform (10) has a top surface, two sides, a front edge, a back edge, two shoulder brackets (11) and a shaft bracket (14).

The shoulder brackets (11) are formed on the top surface (10) respectively close to the sides of the platform (10) and each shoulder bracket (11) has a top edge, an inner side, an outer side and multiple mounting tabs (111). The inner sides of the shoulder brackets (11) face to each other. The mounting tabs (111) are mounted on the outer side of the shoulder bracket (11) and each mounting tab (111) has an inner side and an inner recess. The inner recess is defined on the inner side of the mounting tab (111). The shaft bracket (14) is mounted on the top surface of the platform (10) between the shoulder brackets (11) and adjacent to the back edge, and has amounting hole (141). The mounting hole (141) is defined longitudinally through the shaft bracket (14).

The motor assembly (20) is mounted on the top surface of the platform (10) and has a motor (21) and a worm shaft (22). The motor (21) is mounted on the top surface of the platform (10) and between the shoulder brackets (11) and has a front end. The worm shaft (22) is mounted rotatably on the front end of the motor (21) and has two opposite sides.

Figure 3:
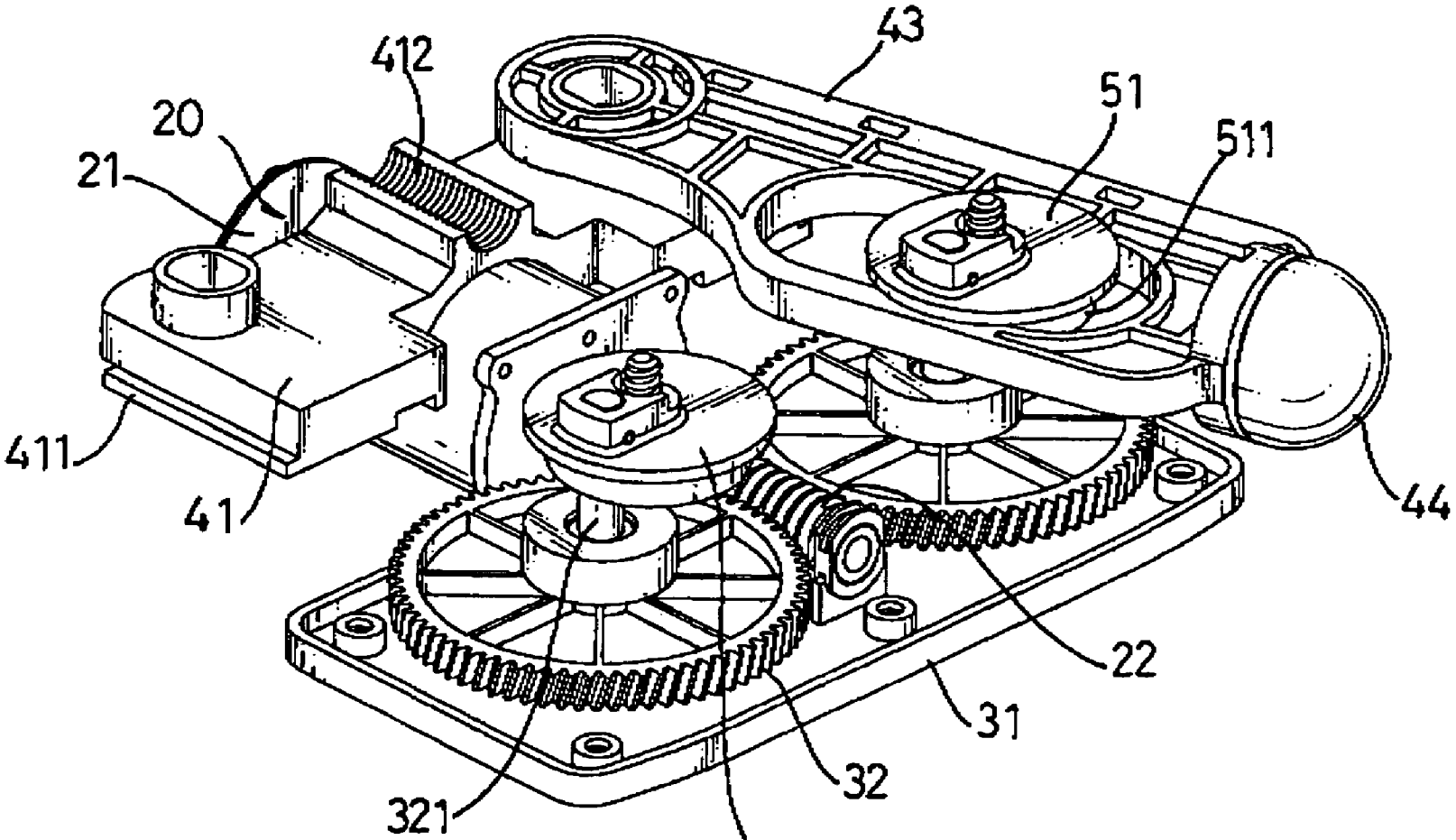
FIG. 3 is a perspective view of the rocker arm and the worm gears of the massage device in FIG. 1.
Figure 4:
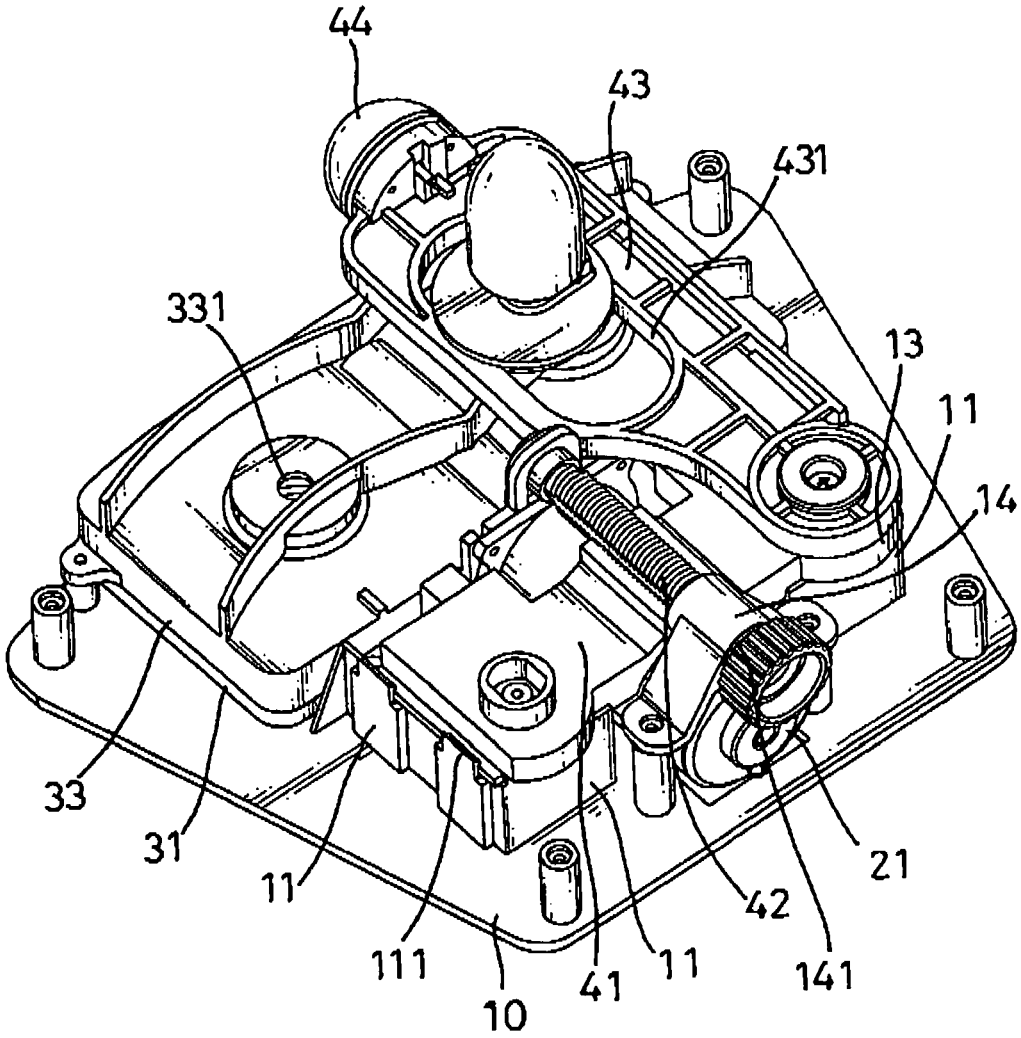
FIG. 4 is a perspective view of the massage device in FIG. 1.

With further reference to FIGS. 3 and 4, the worm gear assembly (30) is mounted on the top surface of the platform (10) ahead of the shoulder brackets (11) and has a mounting board (31), two worm gears (32) and a gear casing (33).

The mounting board (31) is mounted on the top surface of the platform (10) ahead of the shoulder brackets (11) and has a top surface. The worm gears (32) are mounted rotatably on the top surface of the mounting board (31) and respectively engage with the worm shaft (22) on the opposite sides of the worm shaft (22). Each worm gear (32) has a top surface and a central post (321). The central post (321) is mounted on the top surface of the worm gear (32) and has a top end The gear casing (33) is mounted on the mounting board (31), covers the worm gears (32) and has two through holes (331). The through holes (331) are defined through the gear casing (33), and correspond to and respectively allow the central posts (321) to extend through the through holes (331).

The rocker arm assembly (40) is mounted securely or slidably on the shoulder brackets (11) and has a shoulder (41), a threaded shaft (42) and two rocker arms (43).

The shoulder (41) is mounted securely or slidably on the shoulder brackets (11) and has a top surface, two sides, two protrusions (411) and a threaded part (412). The protrusions (411) are formed longitudinally and respectively on the sides of the shoulder (41), and correspond to the shoulder brackets (11). Each protrusion (411) is mounted slidably through the inner recesses in the mounting tabs (111) of a corresponding one of the shoulder brackets (11). The threaded part (412) is formed on the top surface of shoulder (41) and has a thread.

The threaded shaft (42) is mounted rotatably through the mounting hole (141) of the shaft bracket (14) and has an outer thread engaging with the thread of the threaded part (412). The rotation of the threaded shaft (42) results in the longitudinal movement of the shoulder (41).

The rocker arms (43) correspond to the central posts (321) of the worm gears (32), are mounted pivotally on the top surface of the shoulder (41) and are located respectively near the sides of the shoulder (41). Each rocker arm (43) has a distal front edge, a slot (431) and a front kneading head (44). The slot (431) is defined through the rocker arm (43) to allow a corresponding one of the central posts (321) to pass through the slot (431) and has an inner width. The front kneading head (44) is mounted on the distal front edge of the rocker arm (43).

Figure 5:
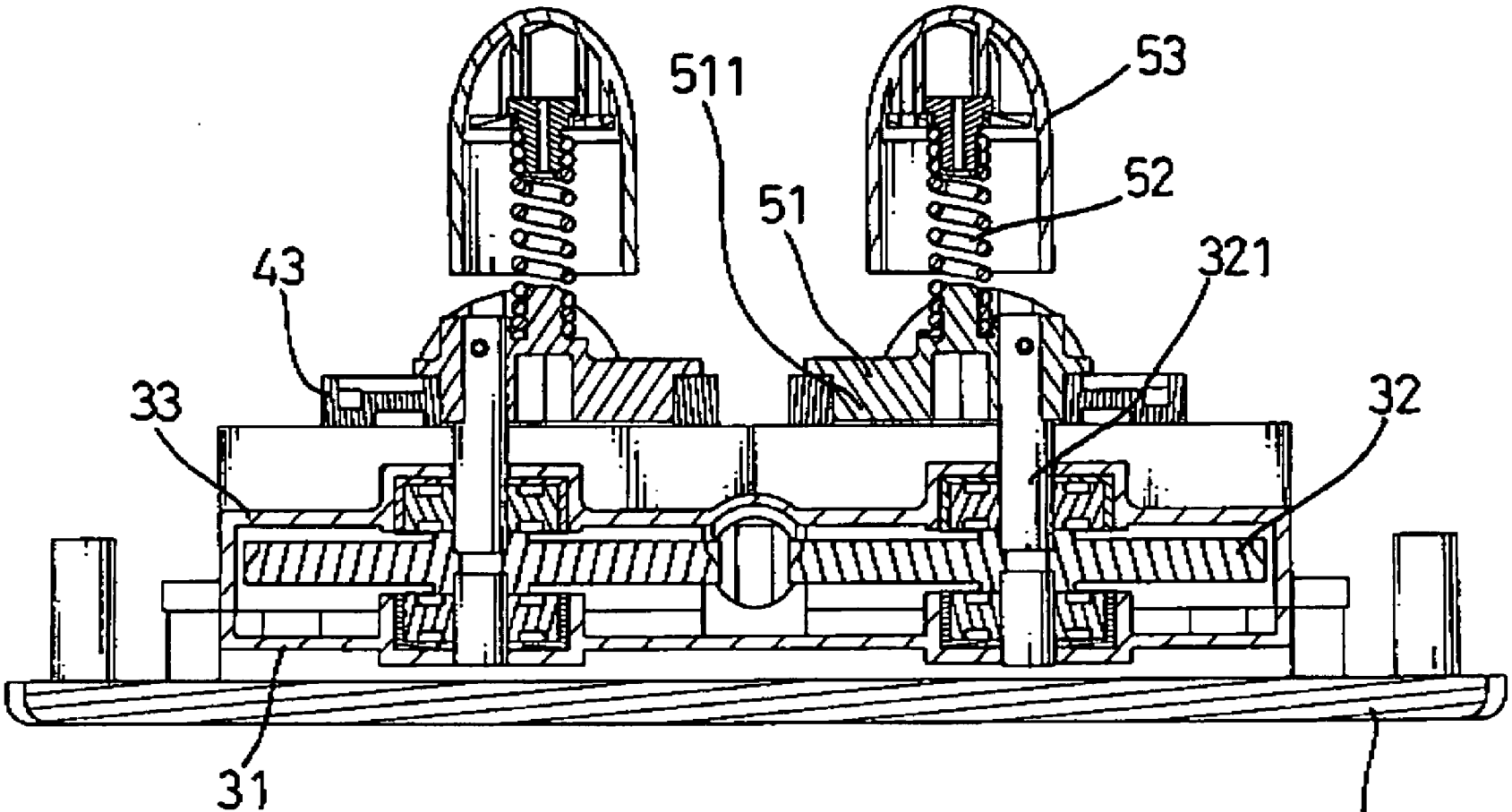
FIG. 5 is a front view of the massage device in FIG. 1 showing that the rotation assemblies rotate and the rocker arms rock opposite to each other.

With reference to FIG. 5, the rotation assemblies (50) correspond to the slots (431) of the rocker arms (43), and correspond to and are mounted respectively on the central posts (321) of the worm gears (32). Each rotation post assembly (50) has an eccentric wheel (51), a spring (52) and a top kneading head (53). The eccentric wheel (51) is mounted securely and eccentrically on the top end of a corresponding one of the central posts (321), is mounted slidably and rotatably through a corresponding one of the slots (431) and has a circular bottom disk (511) and a top disk. The circular bottom disk (511) is mounted on the top end of the corresponding central post (321), is located slidably and rotatably inside the corresponding slot (431) and has a top surface, an outer diameter slightly smaller than the inner width of the slot (431). The spring (52) is mounted on the top surface of the eccentric wheel (51) and has a top end. The top kneading head (53) is mounted on the top end of the spring (52).

Figure 6:
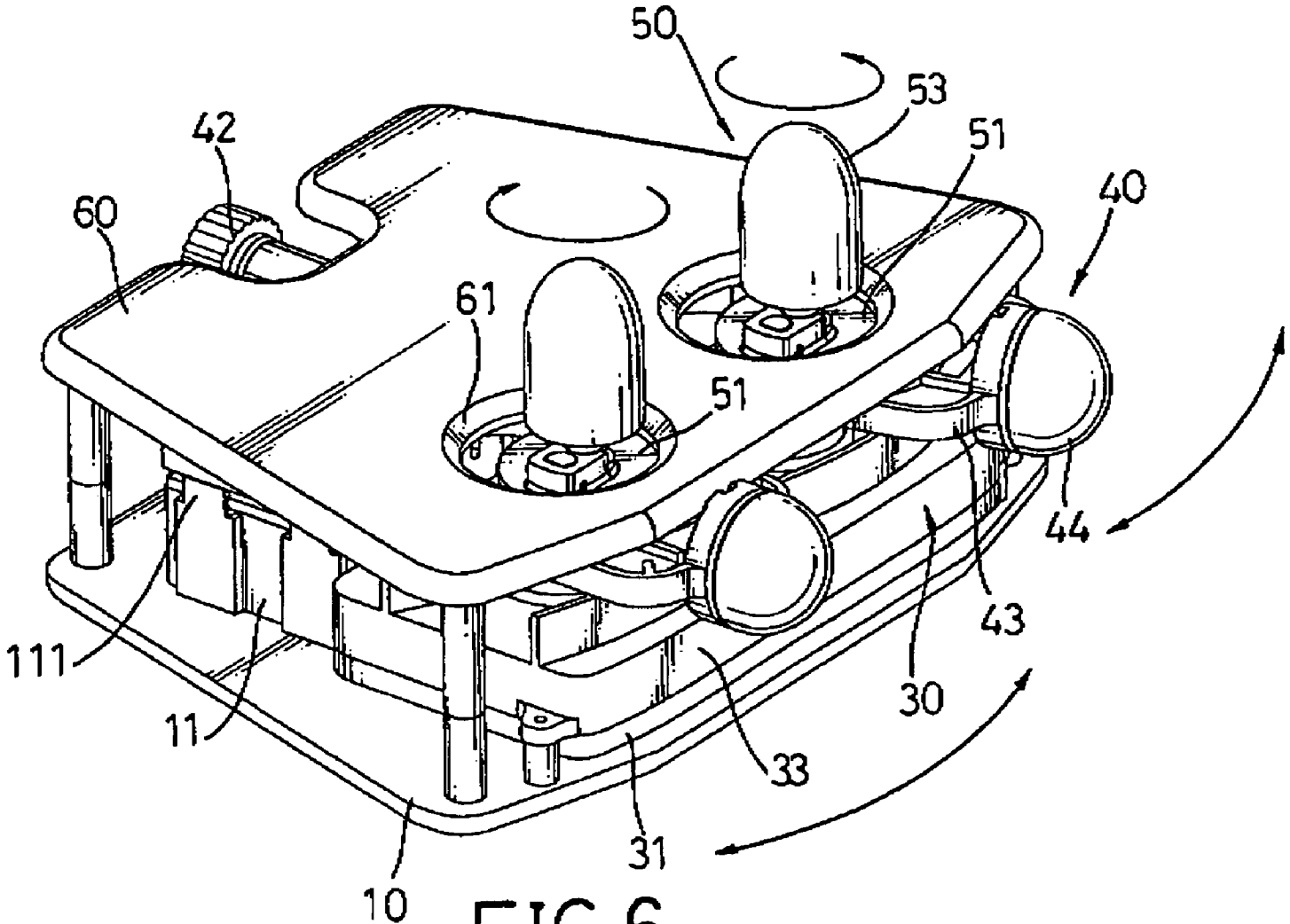
FIG. 6 is an operational view of the massage device in FIG. 1.
Figure 7:
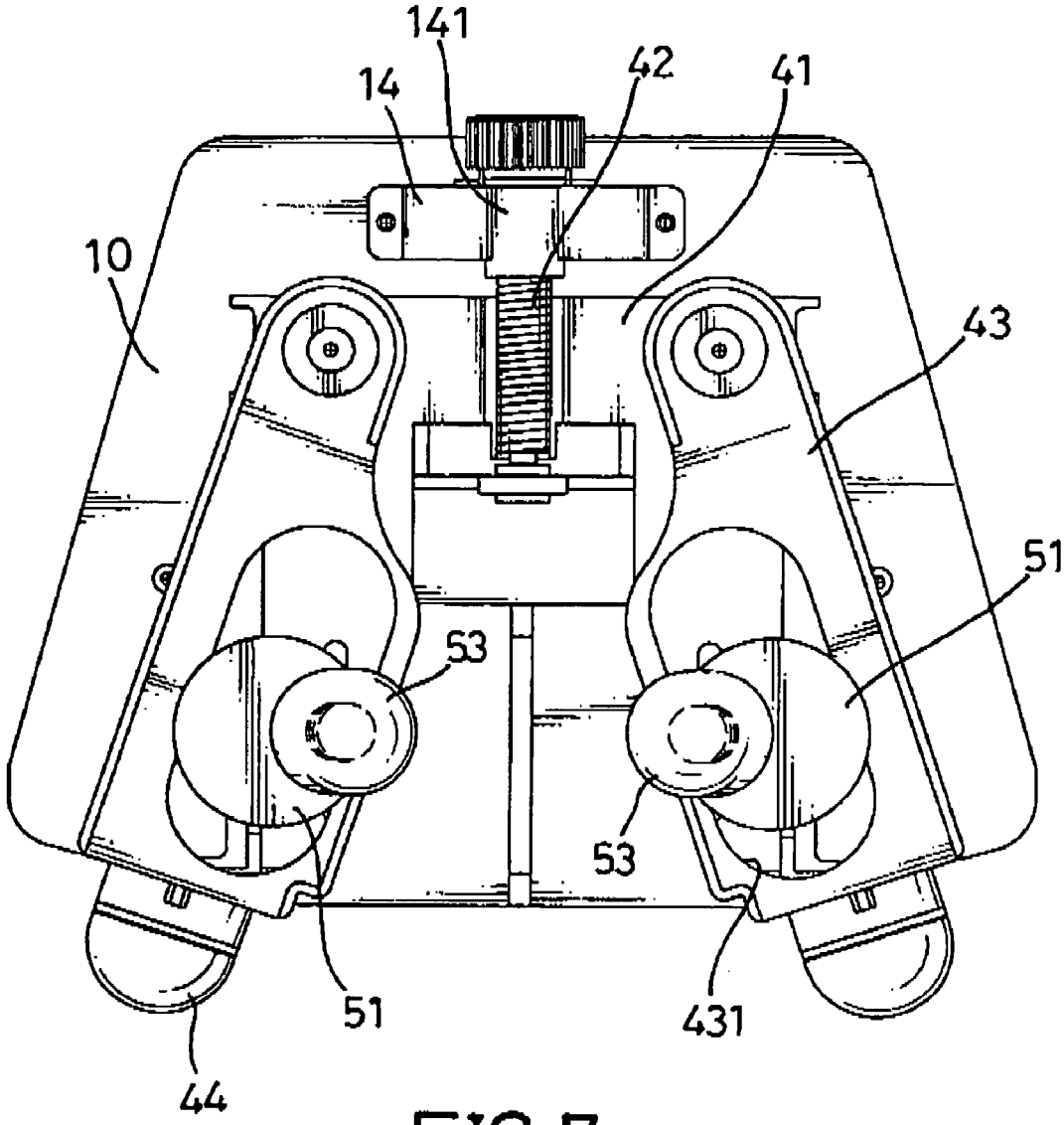
FIG. 7 is an operation view of the massage device in FIG. 6.
Figure 8:
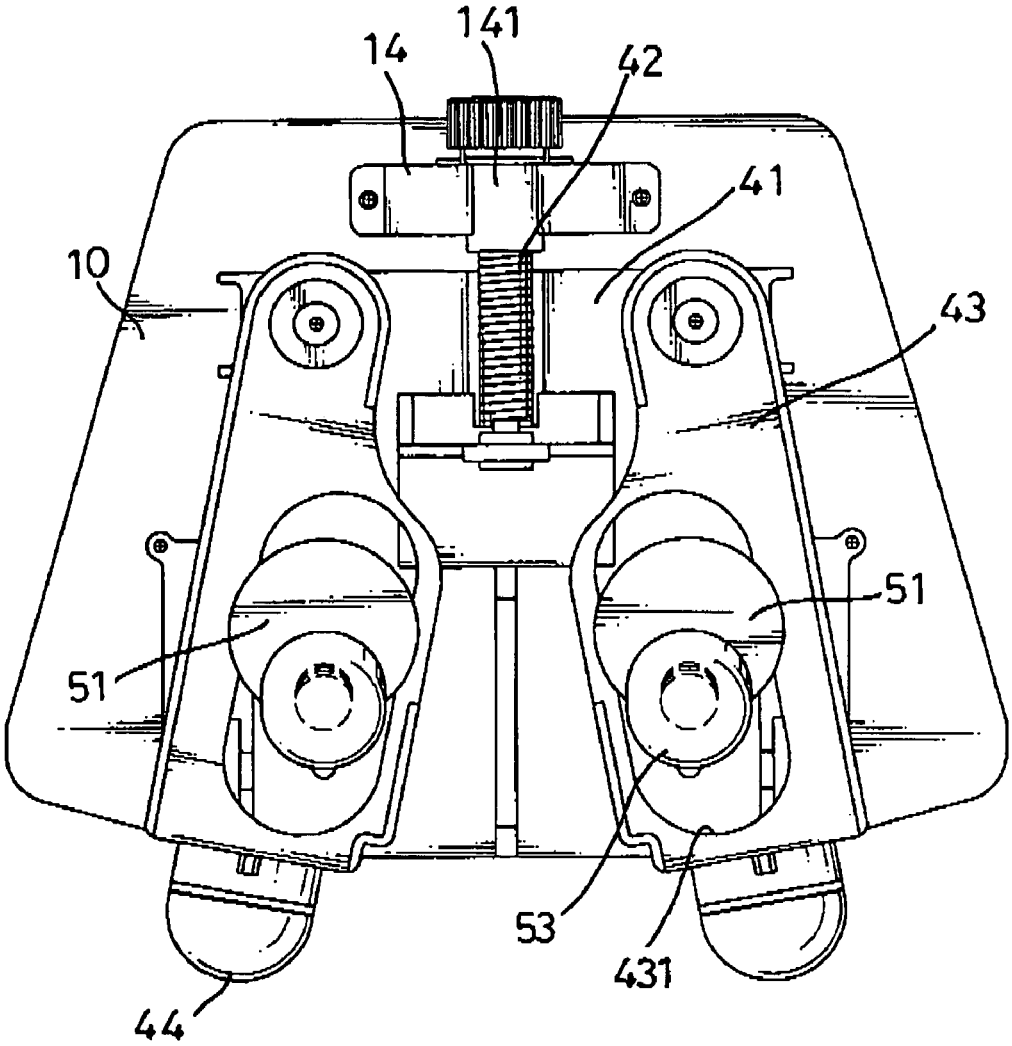
FIG. 8 is an operation view of the massage device following FIG. 7.
Figure 9:
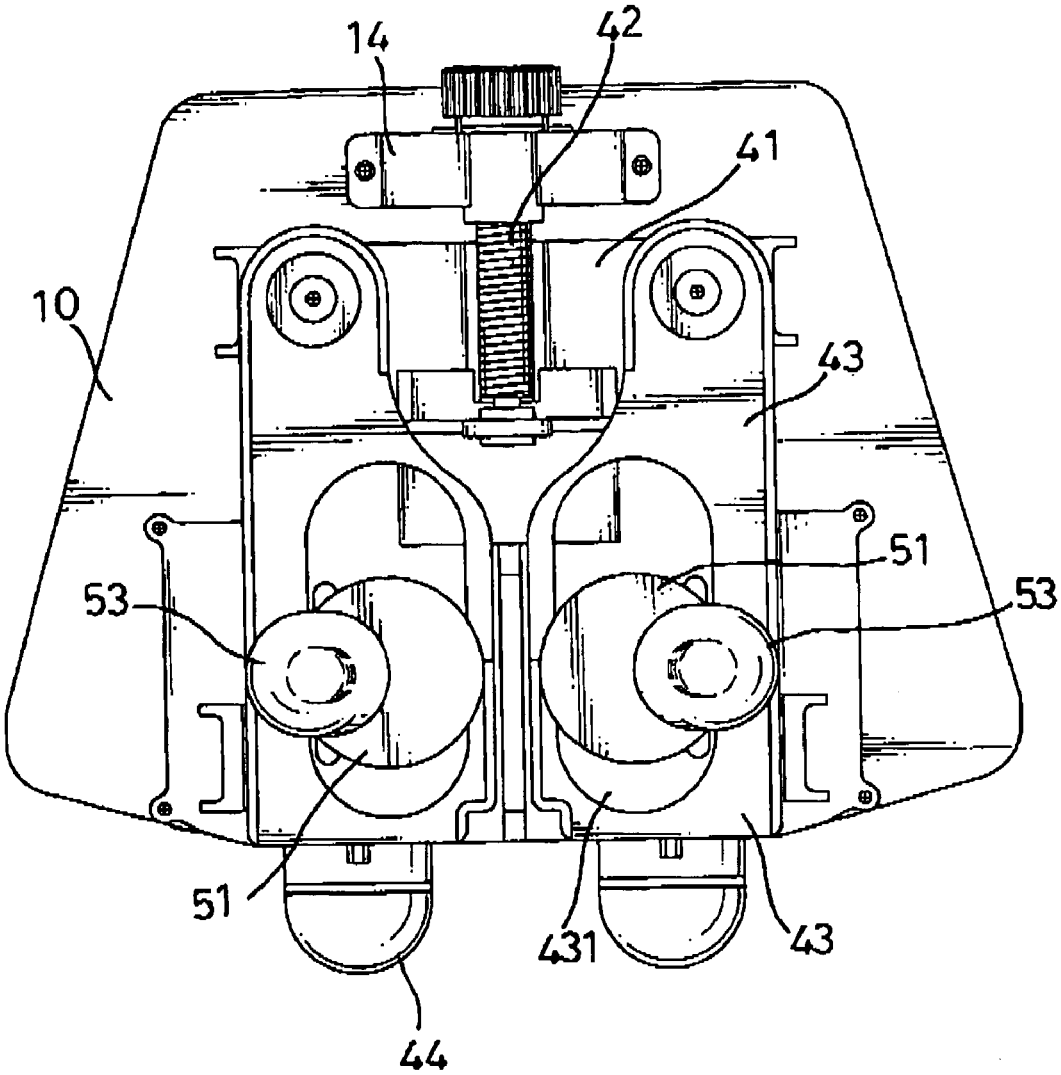
FIG. 9 is a view of the massage device following FIG. 8.
Figure 10:
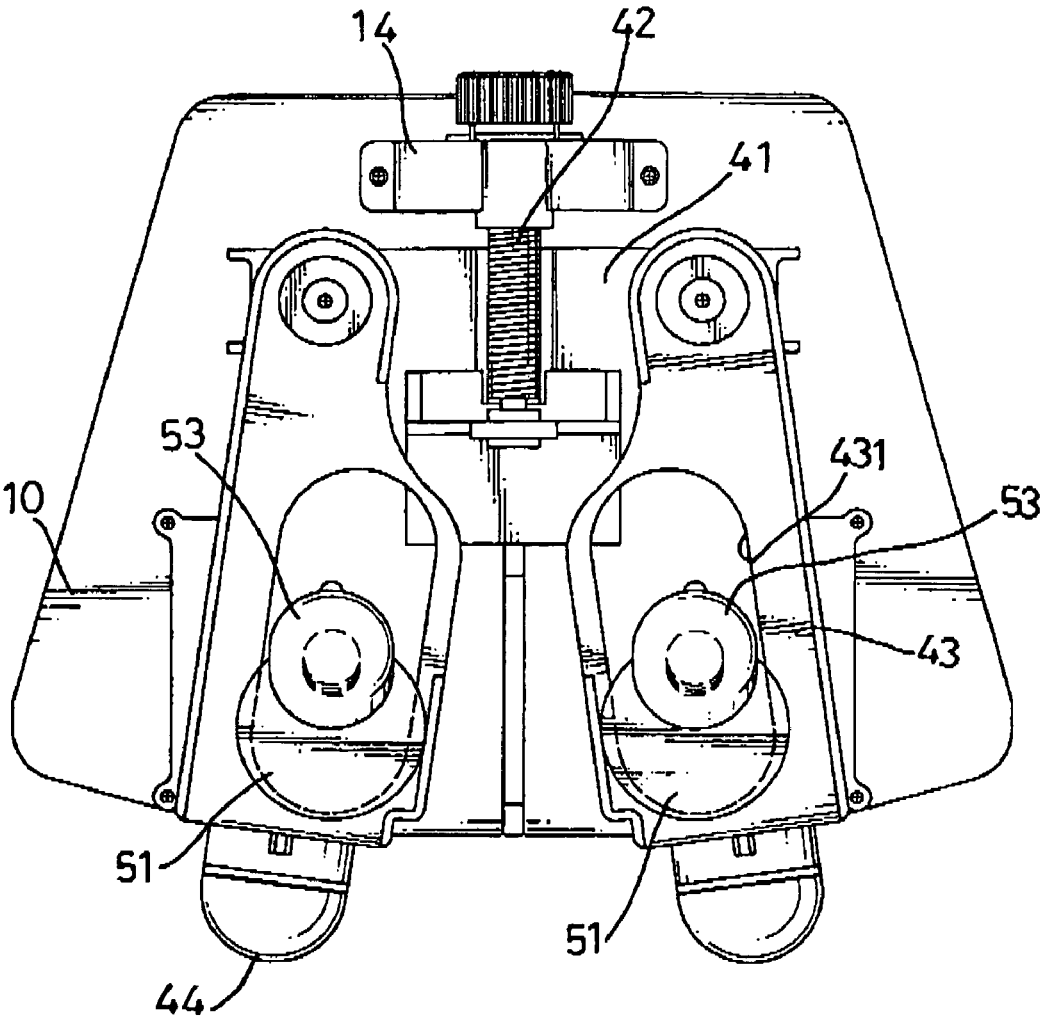
FIG. 10 is an operation view of the massage device following FIG. 9.

With reference to FIGS. 5 and 6, the top cover (60) is mounted on the top surface of the platform (10) and above the rocker arm assembly (40) and the worm gear assembly (30), and has two top through holes (61). The top through holes (61) are defined through the top cover (60) and respectively allow the springs (52) of the rotation assemblies (50) to extend through the top through holes (61).

With reference to FIG. 6, the massage device in accordance with the present invention operates with electricity and is applied to a human body. The motor (21) operates to rotate the worm shaft (22). The rotating worm shaft (22) drives the worm gears (32) to respectively rotate in opposite rotations. The rotating worm gears (32) simultaneously drive the rotation assemblies (50) and the rocker arm assembly (40).

With reference to FIGS. 7 to 10, the rotation assemblies (50) respectively on the central posts (321) of the worm gears (321) rotate in opposite rotations. Therefore, top kneading heads (53) on the top ends of the central posts (321) rotate and massage a muscle group of the human body, such as the soles of the feet.

The circular bottom disks (511) of the eccentric wheels (51) rotate eccentrically and respectively inside the slots (431) of the rocker arms (43) and make the rocker arms (43) rock left and right opposite to each other. Therefore, the front kneading heads (44) respectively on the rocker arms (43) rock left and right and massage a muscle group of the human body, such as the back.

The rotation of the threaded shaft (42) changes the longitudinal position of the shoulder (41) with the rocker arms (43) so that positions of the front kneading heads (44) relative to the front edge of the platform (10) can be adjusted for an appropriate massage to the human body.

The rocker arm and rotation assemblies (40, 50) provide multiple effective massages to different groups of muscles of a human body to mitigate the ache of the muscles. The massage device in accordance with the present invention may be assembled into a bed or back of a chair and allow a user to lie or seat on the bed or chair for relaxation and enjoyment of the massages.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A massage device comprising:

a platform having
- a top surface;
- two sides;
- a front edge;
- a back edge;
- two shoulder brackets formed on the top surface respectively close to the sides of the platform and each shoulder bracket having
  - a top edge;
  - an inner side, wherein the inner sides of the shoulder brackets face to each other; and
  - an outer side; and a motor assembly mounted on the top surface of the platform and having
- a motor mounted on the top surface of the platform and between the shoulder brackets and having a front end; and
- a worm shaft mounted rotatably on the front end of the motor and having two opposite sides;

a worm gear assembly mounted on the top surface of the platform ahead of the shoulder brackets and having
- a mounting board mounted on the top surface of the platform ahead of the shoulder brackets and having a top surface; and
- two worm gears mounted rotatably on the top surface of the mounting board and respectively engaging with the worm shaft on the opposite sides of the worm shaft, and each worm gear having
  - a top surface; and
  - a central post mounted on the top surface of the worm gear and having a top end;

a rocker arm assembly mounted on the shoulder brackets and having
- a shoulder mounted on the shoulder brackets and having a top surface and two sides; and
- two rocker arms corresponding to the central posts of the worm gears, mounted pivotally on the top surface of the shoulder, located respectively near the sides of the shoulder and each rocker arm having
  - a distal front edge;
  - a slot defined through the rocker arm, the slot allowing a corresponding one of the central posts to pass through the slot and having an inner width; and
  - a front kneading head mounted on the distal front edge of the rocker arm;

two rotation assemblies corresponding to the slots of the rocker arms, corresponding to and mounted respectively on the central posts of the worm gears and each rotation post assembly having
- an eccentric wheel mounted securely and eccentrically on the top end of a corresponding one of the central posts, mounted slidably and rotatably through a corresponding one of the slots and having
  - a circular bottom disk mounted on the top end of the corresponding central post, the circular bottom disk located slidably and rotatably inside the corresponding slot and having a top surface;

a top disk formed on the top surface of the circular bottom disk and having a top surface and an outer diameter slightly smaller than the inner width of the slot;

a spring mounted on the top surface of the eccentric wheel and having a top end; and a top kneading head mounted on the top end of the spring.

2. The massage device as claimed in claim 1, wherein the platform further has a shaft bracket mounted on the top surface of the platform between the shoulder brackets adjacent to the back edge and having a mounting hole defined longitudinally through the shaft bracket;

each shoulder bracket further has multiple mounting tabs mounted on the outer side of the shoulder bracket and each mounting tab has an inner side and an inner recess defined on the inner side of the mounting tab;

the shoulder is mounted slidably on the shoulder brackets and further has two protrusions formed longitudinally and respectively on the sides of the shoulder, corresponding to the shoulder brackets and each protrusion mounted slidably through the inner recesses in the mounting tabs of a corresponding one of the shoulder brackets; and a threaded part formed on the top surface of shoulder and having a thread; and the rocker arm assembly further has a threaded shaft mounted rotatably through the mounting hole of the shaft bracket and having an outer thread engaging with the thread of the threaded part.

3. The massage device as claimed in claim 2, wherein the worm gear assembly further has a gear casing mounted on the mounting board, covering the worm gears and having two through holes defined through the gear casing, corresponding to and respectively allowing the central posts to extend through the through holes.

4. The massage device as claimed in claim 3 further comprising a top cover mounted on the top surface of the platform and above the rocker arm assembly and the worm gear assembly, and having two top through holes defined through the top cover and respectively allow the springs of the rotation assemblies to extend through the top through holes.

* * * * *